US006026514A

United States Patent [19]

Fricker

[11] Patent Number: 6,026,514

[45] Date of Patent: Feb. 22, 2000

[54] CONVERTIBLE CREW CAP

[76] Inventor: Mark E. Fricker, 1420 NW. 63rd, Seattle, Wash. 98107

[21] Appl. No.: 09/201,300

[22] Filed: Nov. 30, 1998

[51] Int. Cl.[7] ..... A42B 1/04

[52] U.S. Cl. ..... 2/209.11; 2/171; 2/207; 2/209.7

[58] Field of Search ..... 2/171, 209.11, 2/207, 209.3, 209.7

[56] References Cited

U.S. PATENT DOCUMENTS

| | | | |
|---|---|---|---|
| D. 67,049 | 4/1925 | Rothenberg . | |
| D. 336,764 | 6/1993 | Minton | D2/257 |
| 344,368 | 6/1886 | Freschl | 2/209.11 |
| 2,878,479 | 3/1959 | Schuessler | 2/172 |
| 4,551,859 | 11/1985 | Gerhardt | 2/172 |
| 4,662,007 | 5/1987 | Lipkin | 2/195 |
| 4,845,782 | 7/1989 | Gregg | 2/172 |
| 5,109,548 | 5/1992 | Balaban et al. | 2/175 |
| 5,351,343 | 10/1994 | Harbison | 2/423 |
| 5,619,754 | 4/1997 | Thurwanger et al. | 2/418 |
| 5,799,335 | 9/1998 | Ethier | 2/209.11 |

*Primary Examiner*—Diana Oleksa
*Attorney, Agent, or Firm*—Kathleen T. Petrich

[57] ABSTRACT

Apparatus and a method for converting a conventional crew cap into a tubular article of outerwear. The crew cap includes a flexible outer layer and a flexible inner layer that together forms a crown portion and an opened end. An opening is positioned on and defined by either the inner layer or outer layer. In a first use, the open end of the inner layer is adapted to be worn by a wearer such that the crown portion of the inner layer covers the wearer's crown. To convert the cap into tubular article of outerwear, the layer not containing the opening is completely pulled through the opening to form a tubular article of outerwear having a first and second open end. The tubular article is adaptable to be worn by the wearer as a headband or neck warmer.

21 Claims, 4 Drawing Sheets

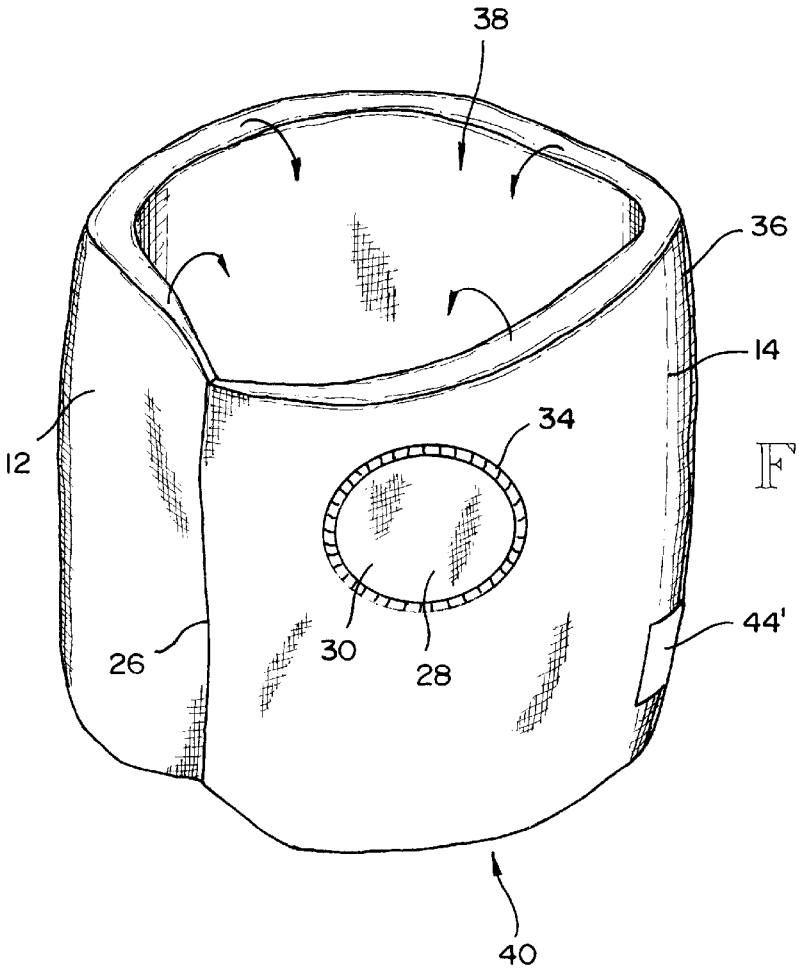
FIG. 3
FIG. 4
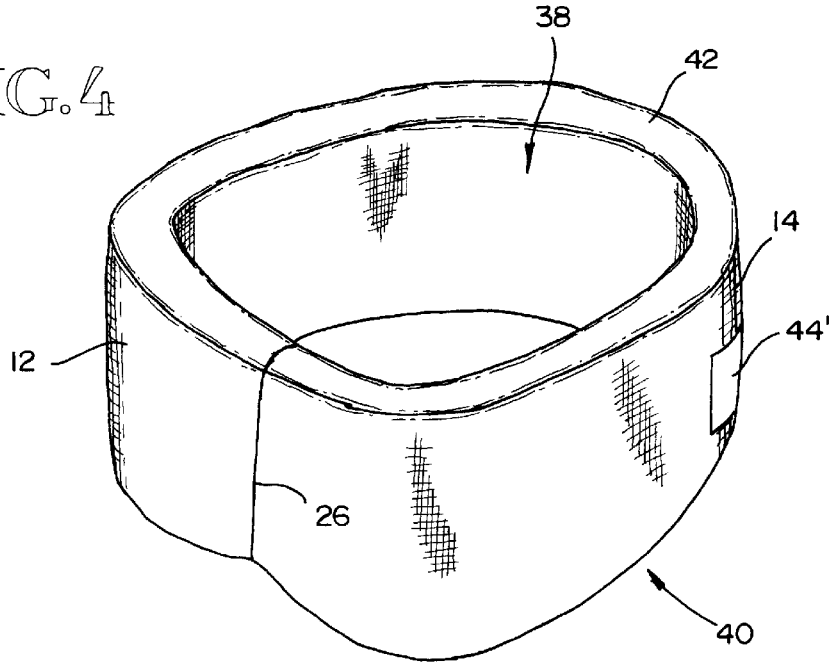

CONVERTIBLE CREW CAP

TECHNICAL FIELD

The present invention relates to headwear. More particularly, the present invention relates to a crown-covering crew cap that is easily converted into an ear-covering headband or a neck warmer, and a method for converting same.

BACKGROUND OF THE INVENTION

Hats are worn to keep the wearer's upper head (the crown) covered to mitigate heat loss in cooler temperatures. However, after a day of heavy outdoor activity, such as skiing, a hat that covers the wearer's crown in typically undesirable as the wearer gets hot and needs to remove the hat to cool down. But most individuals still wish to cover their ears, and as such, use another piece of outerwear clothing: an ear-covering headband that does not have a crown-covering portion. Buying two articles of outerwear is expensive, and carrying two articles of outerwear is cumbersome.

One approach is to have a convertible crown-covering hat that converts to a ear-covering headband is disclosed in Balaban et al., U.S. Pat. No. 5,109,548, granted May 5, 1992, and entitled "Weather Adaptable Ski Hat." However, Balaban et al. is heavy and cumbersome for carrying and wearing. It is also discloses a potentially uncomfortable knot of a drawstring positioned at the crown that would be in contact with a wearer's crown. Additionally, the invention in Balaban could be considered aesthetically unattractive, in either the crown-covering cap/hat version or in the ear-covering headband.

SUMMARY OF THE INVENTION

The present invention is directed to an aesthetically pleasing and easily convertible crew cap that is readily converted to an ear-covering headband or neck warmer. The present invention also includes a method for converting a crown-covering cap into a tubular article of outerwear and back again into a crown-covering cap.

The crew cap, or hat, of the present invention includes a flexible outer layer and a flexible inner layer that is attached together to form a crown portion and an open end. The cap of the present invention also includes an opening that is positioned on and defined by either the outer or inner layer. The opening is of a size to substantially completely receive the layer not containing the opening when an external pulling force is applied to the layer not containing the opening.

In a first use, the open end of the inner layer is adapted to be worn over a wearer's head where the crown portion of the inner layer covers' a wearer's head at the wearer's crown.

In a second use, the cap is converted to a tubular article of outerwear by pulling the layer not containing the opening substantially completely through the opening to form a tubular shape having two open ends. The resulting tubular article of outerwear is adaptable to be worn either as a headband or a neck warmer.

In preferred form, the opening is reinforced. The opening may be of any shape, but is preferably a circular hole having a diameter of one to four inches, with two inches as the preferred size.

In one embodiment of the preferred invention, the layer not containing the opening may include a pull tab adjacent the opening. In this way, the pull tab aids the wearer in pulling the layer not containing the opening through the opening.

For aesthetic purposes, the opening is positioned on and defined by the inner layer. In this way, the hole is not seen externally of the cap, when in use. Additionally, when the cap is converted to the tubular article of outerwear, the resulting tubular shape may be folded in half to form a narrower width ear-covering headband and to hide the opening on the inverted inner layer.

According to another embodiment of the present invention, the cap may include at least one seam to attach the inner layer to the outer layer. In this embodiment, the opening is positioned adjacent the at least one seam for aesthetic and structural integrity purposes. Additionally, the seam acts as a marker to readily find the opening for converting the cap in darkness or where the wearer is sight impaired.

According to yet another embodiment, the present invention may include a space for indicia, such as a logo. As the cap of the present invention is ideal for skiers, snowboarders, and other winter sports enthusiasts, corporate sponsors can readily display its logo or name on either layer for maximum visibility.

The present invention also is directed to a method of converting a crown-covering cap into a tubular article of outerwear, such as an ear-covering headband or neck warmer. The steps of conversion are discussed above. The method claims also reversing the process to convert back to the crown-covering cap. The method is also directed to a method of converting a tubular article of outerwear to a crown-covering cap.

These and other features and benefits will be discussed in further detail in the various figures of the attached drawing, the Brief Description of the Drawing, and the Best Mode for Carrying Out the Invention.

BRIEF DESCRIPTION OF THE DRAWING

Like reference numerals are used to designate like parts throughout the several views of the drawing, wherein:

FIG. 3 is a pictorial view of the now converted cap of FIG. 1 where the outer layer is pulled all the way through the opening to form a resulting tubular article of outerwear;

FIG. 4 is a pictorial view of the ring of FIG. 3 where the tubular article is folded in half and to cover the opening;

BEST MODE FOR CARRYING OUT THE INVENTION

Figure 1:
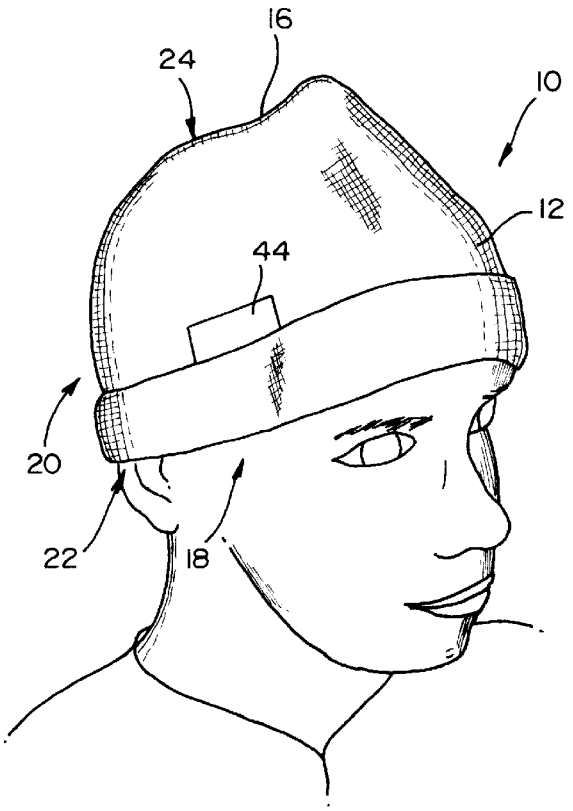
FIG. 1 is a pictorial view of the convertible crew cap of the present invention having an outer layer and an inner layer forming a crown portion and an open end to cover a wearer's crown and a portion of the wearer's head.
Figure 2:
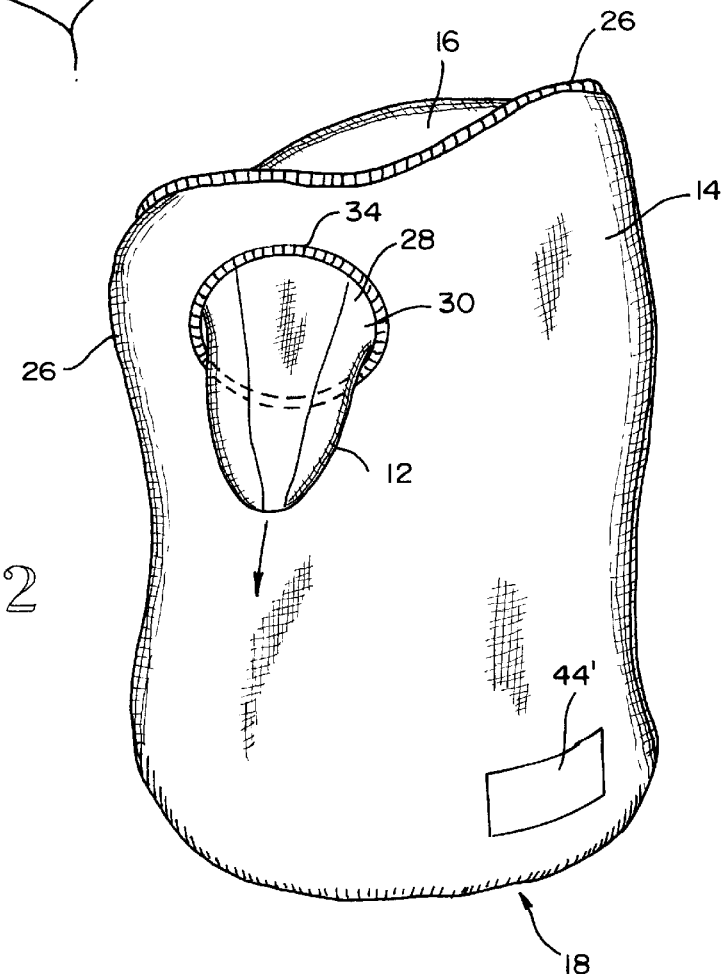
FIG. 2 is a pictorial view of the cap shown inverted where the inner layer has traded positions with the outer layer and disclosing an opening in the inner layer from which the outer layer is pulled through the opening.

The present invention relates to a convertible crew cap, such as the kind shown in FIG. 1. The cap 10 includes a flexible outer layer 12 and a flexible inner layer 14 (FIG. 2). Together the outer layer and inner layer form a crown portion 16 and an open end 18. In use, as shown in FIG. 1, the open end of the cap surrounds a portion 20 of the wearer's head 22 and particularly the crown portion 16 of the inner layer covers the wearer's crown portion 24.

In preferred form, cap 10 is a knit crew cap, like those used by sailors. The knitted wool, cotton, acrylic, or other knit material, is naturally flexible. Typically, a traditional crew cap has an inner layer and an outer layer sewn together by at least one seam 26.

Figure 8:
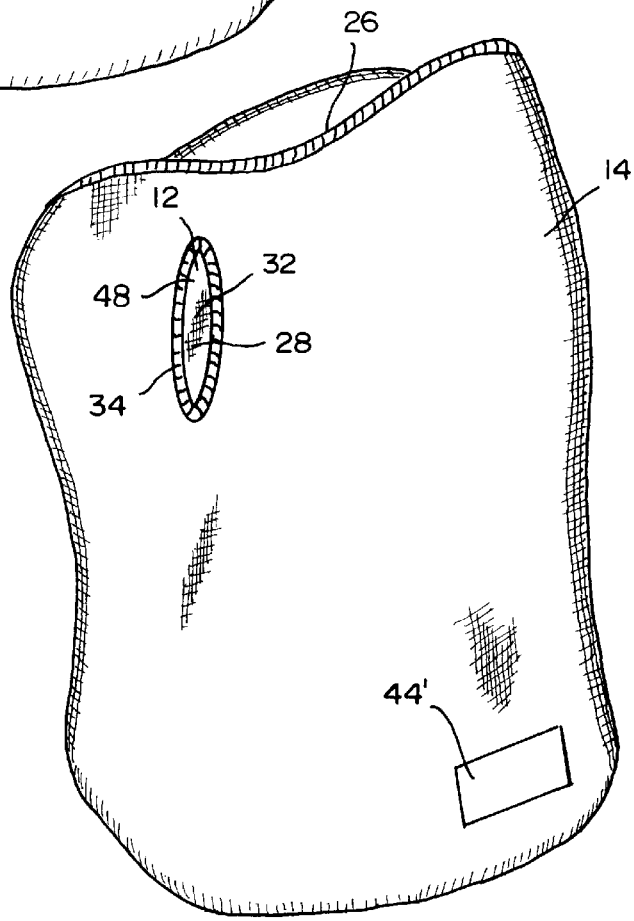
FIG. 8 is a pictorial view like that of FIG. 2 but showing an alternate embodiment of the opening.

The cap 10 of the present invention further includes an opening 28, which is defined by either the inner layer 14 or the outer layer 12. The opening must be of a size to allow the other layer to be pulled completely through the opening during conversion. The opening may be a substantially circular hole 30 (FIG. 2) or a slit 32 (FIG. 8). The hole 30 may be in the range of one to four inches, although a two inch hole has been used with optimal results. Preferably, the hole is reinforced by a triple seam 34. Also, the opening is preferably positioned on the inner layer for aesthetic purposes. If the cap includes a seam, the opening 28 is optimally placed adjacent the seam for aesthetic purposes and for structural integrity of the cap.

Referring also to FIG. 3, the cap 10 is converted by pulling the layer not containing opening 28 substantially completely through opening 28. As the preferred form dictates that the opening be positioned on the inner layer, the cap is first inverted as shown in FIG. 2. The outer layer 12 is pulled through opening 28 of inner layer 14. The resulting tubular article 36 is shown in FIG. 3. Thus, the resulting tubular article is essentially a ring with one half of the outer layer and one half of the inner layer, as viewed externally of the ring.

Figure 5:
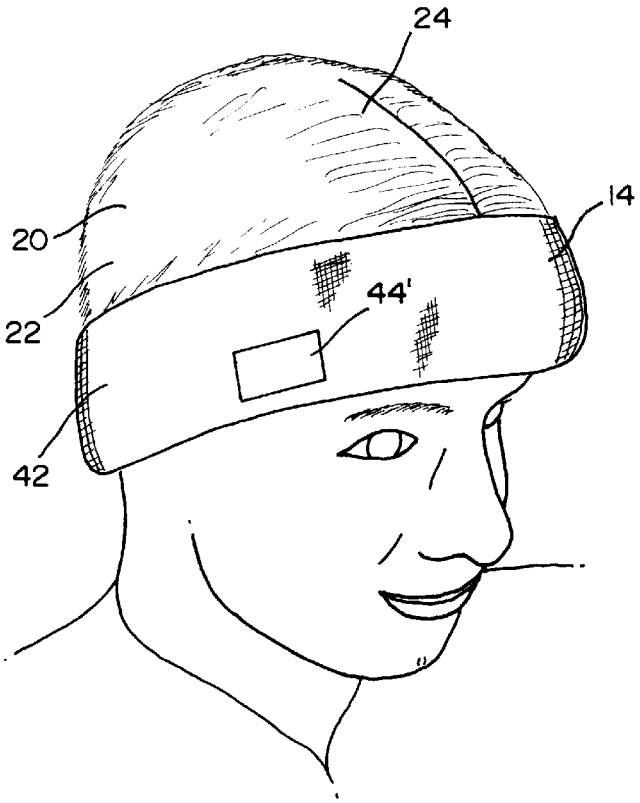
FIG. 5 is a pictorial view of the ring of FIG. 4 now in condition to be worn as an ear-covering headband.
Figure 6:
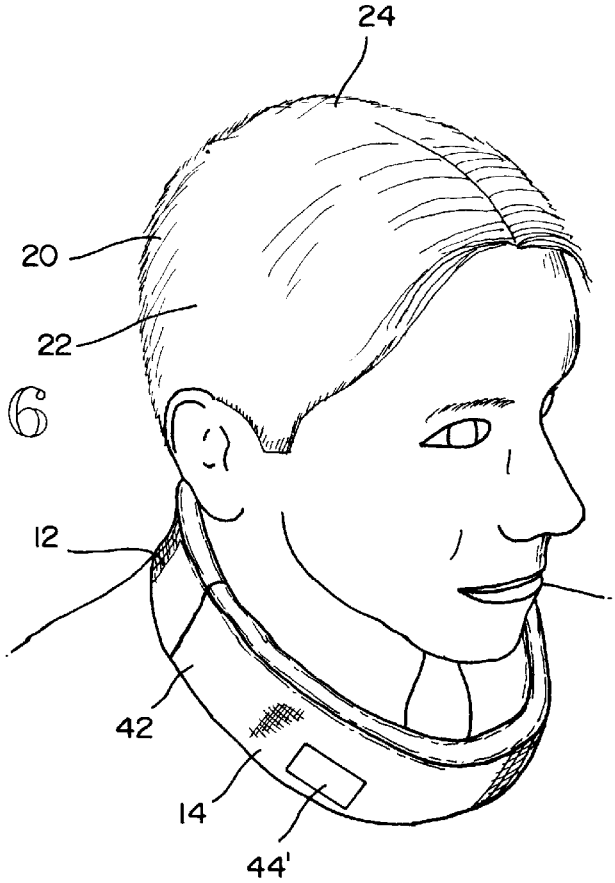
FIG. 6 is a pictorial view of the of the ring of FIG. 4 worn as a neck warmer.

Referring now to FIGS. 4–6, as well as FIG. 3, the resulting tubular shape 36 no longer has a crown portion but has two open ends 38, 40. The tube 36 is folded to form a thicker, but half-width tubular band 42, as shown in FIG. 4. The band 42 is now ready for use as an ear-covering headband, as shown in FIG. 5. The band 42 may be used as a neck warmer, such as shown in FIG. 6, or the tube 36, as shown in FIG. 3, may also be adapted for use as a neck warmer (not shown).

The cap further includes a place for indicia 44, such as a company logo/corporate sponsor, that can be visible to others. To take full advantage of corporate sponsorship/advertising, the logo may be positioned on both the outer layer 12 when the cap is worn as a crown-covering cap (FIG. 1) and on the inner layer 14 (44') when the cap is converted to a headband 42 or neck warmer 36 or 42 (FIGS. 3–6).

Figure 7:
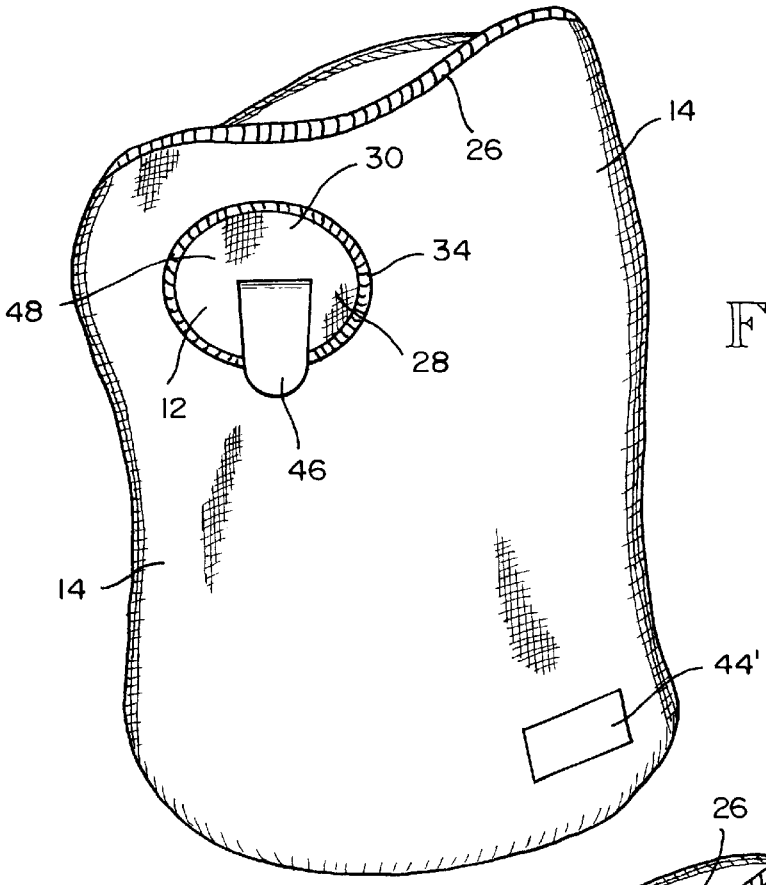
FIG. 7 is a pictorial view like that of FIG. 2 where an embodiment of the invention further includes a pull tab to aid in pulling the outer layer of the cap through the opening of the inner layer.

Referring to FIG. 7, an optional pull-tab 46 may be positioned on the interior side of 48 the outer layer 12 in the area corresponding to the opening 28 on the inner layer 14. The pull-tab 46 aids in pulling the outer layer through the opening of the inner layer to form the tube 36. The pull-tab may also be a ring (not shown).

When the wearer wishes to convert the tube 36 or headband 42 back to the cap, the process is generally reversed. The wearer unfolds the folded tubular shape 42 back to the tubular shape shown in FIG. 3, if the starting point is the headband as shown in FIGS. 4–6. Next, the outer layer 12 is pulled through the opening 28. The two open ends 38, 40 are gone. Now, in their place are the crown portion 16 and the oppositely situated open end 18, as shown in FIG. 2. The cap is now inverted right side out to form the cap of FIG. 1.

The invention also encompasses retrofitting existing crew caps, and the like. A reinforced opening is added to a crew cap having an inner layer of a size to allow the outer layer to be substantially completely through the opening to form the tube or headband.

The present invention is an improvement on that disclosed in Balaban in that it is aesthetically pleasing, in either the crown-covering cap mode or in the headband or neck warmer mode. Also, the invention is lightweight, easy to carry and easy to use. The cap of the present invention does not lose its shape: there is no drawstring to rely on for crown-covering utility or keeping its shape to act as an ear-covering headband.

The present invention also is directed to a method of converting a crown-covering cap into a tubular article of outerwear, as well as converting a tubular article of outerwear to a crown-covering cap. The steps are already discussed above.

The illustrated embodiments are only examples of the present invention and, therefore, are non-limitive. It is to be understood that many changes in the particular structure, materials, and features of the invention may be made without departing from the spirit and scope of the invention. Therefore, it is my intention that my patent rights not be limited by the particular embodiments illustrated and described herein, but rather by the following claims interpreted according to accepted doctrines of claim interpretation, including the doctrine of equivalents and reversal of parts.

What is claimed:

1. A convertible crew cap comprising:

a flexible outer layer and a flexible inner layer attached together to form a crown portion and an open end, said outer and inner layer being attached together at an apex of the crown and at the open end, wherein the open end of the inner layer is positionable over a wearer's head such that the crown portion of the inner layer covers a wearer's head at the wearer's crown; and an opening being positioned on and defined by either the outer or inner layer, said opening being of a size to substantially completely receive the layer not containing the opening when an external pulling force is applied to the layer not containing the opening;

wherein the cap may be converted by pulling the layer not containing the opening through the opening such that a tubular article having a first open end and a second open end is formed, and wherein the resulting tubular article is adaptable for use by the wearer around the wearer's neck or head.

2. The convertible cap according to claim 1, wherein the opening is reinforced.

3. The convertible cap according to claim 1, wherein the opening is substantially circular with a diameter in the range of one to four inches.

4. The convertible cap according to claim 3, wherein the diameter is approximately two inches.

5. The convertible cap according to claim 1 further comprising: a pull tab that is attached to the layer not containing the opening but positioned adjacent the opening of the adjacent layer.

6. The convertible cap according to claim 1, wherein the opening is positioned on and defined by the inner layer.

7. The convertible cap according to claim 6, wherein the cap after conversion to a tubular article may be folded to form a narrower width band.

8. The convertible cap according to claim 1, wherein the cap after conversion to a tubular article may be folded to form a narrower width band.

9. The convertible cap according to claim 1, wherein the outer layer and the inner layer are attached together by at least one seam.

10. The convertible cap according to claim 9, wherein the opening is positioned adjacent the at least one seam.

11. The convertible cap according to claim 10, wherein the opening is positioned on and defined by the inner layer.

12. The convertible cap according to claim 1, wherein the outer layer includes an area for indicia.

13. The convertible cap according to claim 1, wherein the inner layer includes an area for indicia.

14. The convertible cap according to claim 13, wherein the outer layer includes an area for indicia.

15. A method of converting a crown-covering cap into a tubular article of outerwear comprising the steps of:

providing a cap having a flexible outer layer and a flexible inner layer together forming a crown portion and an open end, wherein said cap's outer and inner layer are attached together at an apex of the crown and at the open end, and an opening being positioned on and defined by either the outer or inner layer;

pulling the layer not containing the opening through the opening; and forming a tubular shape having a first open end and a second open end, wherein the tubular shape is adaptable for use as an article of outerwear.

16. The method according to claim 15, wherein the opening is positioned on and defined by the inner layer.

17. The method according to claim 16 further comprising the step of: inverting the outer layer, prior to pulling the outer layer through the opening of the inner layer, whereby the inner layer is now the outer layer and the outer layer is the inner layer.

18. The method according to claim 15 further comprising the step of: folding the tubular shape in half forming a band that is adaptable for use as a neck warmer or a headband.

19. The method according to claim 15, further comprising the step of:

converting the tubular shape back to a crown-covering cap by pulling the layer not containing the opening through the opening, thereby forming a cap with a crown portion and an open end.

20. The method of claim 19, further comprising the step of converting the headband back to a crown-covering cap by:

unfolding the band from the half width position to the full width position; and pulling the layer not containing the opening through the opening, thereby forming a cap with a crown portion and an open end.

21. A method of converting a tubular article of outerwear into a crown-covering cap comprising:

providing a tubular article of outerwear having a first open end and a second open end, wherein the tubular article is formed from a flexible outer layer and a flexible inner layer that are stitched-closed along part of the width, and wherein said tubular article further includes an opening being positioned on and defined by either the outer or inner layer;

pulling the layer not containing the opening through the opening and forming a crown-covering cap wherein the portion of the tubular article that is stitched-closed forms an apex of the cap.

* * * * *